United States Patent [19]

Polster

[11] 4,074,530

[45] Feb. 21, 1978

[54] HOT GAS ENGINE CONTROL

[75] Inventor: Norman E. Polster, Argenta, Canada

[73] Assignee: Josam Manufacturing Co., Michigan City, Ind. ; a part interest

[21] Appl. No.: 746,128

[22] Filed: Nov. 30, 1976

[51] Int. Cl.[2] ..... F02G 1/06

[52] U.S. Cl. ..... 60/518

[58] Field of Search ..... 60/518

[56] References Cited

U.S. PATENT DOCUMENTS

| | | | |
|---|---|---|---|
| 3,315,465 | 11/1965 | Wallis | 60/518 |
| 3,416,308 | 12/1968 | Livezey | 60/518 |
| 3,482,457 | 12/1969 | Wallis | 60/518 X |
| 3,994,136 | 11/1976 | Polster | 60/518 |

*Primary Examiner*—Allen M. Ostrager

*Attorney, Agent, or Firm*—Fred Ornstein

[57] ABSTRACT

In a hot gas engine, for example, of the Stirling cycle type, having a displacer member and associated working piston member, normally moving in respective cylinder spaces with a selected phase relation and having controllable torque output in magnitude and direction, or a plurality of associated displacer piston pairs, the displacer drive affords changeable control of displacer stroke length between a zero or minimum stroke length and a maximum and phase reversal, with or corresponding to a torque requirement of direction and magnitude between a minimum and maximum, thereby to minimize windage type energy losses due to displacer motion at times of low power or low torque demand, and also with displacer stroke length control, controlling torque and output direction.

10 Claims, 9 Drawing Figures

HOT GAS ENGINE CONTROL

BACKGROUND

In contrast with internal combustion engines where the operating energy heating a working gas, indeed in part the operating gas itself, is derived from a chemical reaction or burning of a fuel within an operating gas space, hot gas engines, for example, Stirling cycle engines, drive operating thermal energy from a heat source external of the working gas space. Though more recently heat systems have been proposed utilizing heat derived from sources other than combustion in classical sense, even today usually the source is an external combustion carried out in immediate association with the engine, the thermal energy of which is supplied to working gas through a gas chamber wall either directly or by a heat transfer medium, whence the yet common designation "external combustion engines."

Whereas operation of an internal combustion engine is readily achieved with practical precision and good response time-wise, even for vehicular propulsion, as is evident in the typical fuel throttle controls used in various automobiles over many decades, for hot gas engines, engine power or torque output control through control of fuel supply, or other means of regulating combustion and heat developed, or by control of fluid whereby heat is transferred from a primary or secondary heat source to a point of transfer to the working gas, has generally been unacceptable for engines used for vehicle propulsion, especially in automobiles, because of inherent delay in the system and as well in some instances because of complexity of control device means required.

Hence, especially for hot gas engines used in automobiles, various systems of control have been proposed to obtain quicker response, for example, by changing the quantity of, or the pressure of, the working gas effectively present in the engine gas working spaces. But again the control systems adopted have entailed considerable complexity of structure, even where the speed and character of response has been otherwise acceptable. Likewise many arrangements have been proposed for torque and power control by change of the phase of displacers relative to their associated pistons.

However, even with the latter forms of control in an automobile, there arises the further disadvantage that, unless a clutch or other decoupling means is used between engine and drive wheels, then under conditions of a higher speed vehicle operation with comparatively low torque and power demand, as for example, running at constant higher speeds on a level road, nonetheless there are inherent windage type energy losses due to continued relative movement of displacers and working gas. A similar disadvantage is present for other engines continuously coupled directly to a load moving continuously but with variable speed torque, or power requirement.

GENERAL DISCUSSION - PRESENT INVENTION

In a hot gas engine, having a displacer member and an associated working piston member or a plurality of such associated members, movable in respective communicating displacer and working piston cylinder spaces, with the displacers driven in a set phase relation to and by the respective pistons when power is being developed, by the present invention, the displacer stroke length and phase direction is made selectably adjustable by the driver or operator. Thus, at times when the output torque or power demand is reduced, by displacer stroke reduction the effective motion of displacer and working gas may be reduced so that displacer windage energy losses are reduced even though reciprocation of the piston continues, as would be the case for an engine connected without intervening clutch or the like to drive wheels in a moving automotive vehicle moving at constant speed on a level road.

A preferred form of the invention is hereinafter described as embodied in a hot gas engine similar to that shown and described in my U.S. Pat. application Ser. No. 593,162, filed July 3, 1975, now U.S. Pat. No. 3,994,136, granted Nov. 30, 1976; but it is to be understood that in principal it is applicable to other arrangements and environments.

In this disclosed invention-embodying specific engine form, two pairs of aligned displacer cylinders communicating with respective ones of two pairs of aligned work cylinders have displacer members and piston members connected in pairs, each pair being connected by a respective axial reciprocating connecting member as a connecting shaft or rod means; by respective transmission means the displacers being connected to each other for simultaneous movement with appropriate 90° phase offset, and the pistons pairs being similarly connected to each other with a 90° phase offset and also connected to an output; and finally, control means in effect interconnect the transmission means, hence the work pistons and displacer members, so that the phase relation of each piston and its respective displacer is the same throughout the engine, and the pistons and displacers during a torque development operation mode move simultaneously.

In each transmission means, hypocycloidal gearing is used in association with a respective rotary shaft from the rotary motion of which there is derived reciprocating motion of the related pistons or displacers; or which in the case of pistons is rotated by power-developing reciprocation of the pistons. This gearing comprises, at each pair of opposed members, a planetary-like gear rotatably eccentrically supported by the rotary shaft, to orbit meshed within a normally fixed internal ring gear with 2 to 1 ratio, the planet itself carrying at its pitch circle a crank pin engaged with the axial connecting member of the adjacent opposed aligned displacer or piston pair; and uniform angular velocity of the planetary gear center, the pin center accordingly translating or shifting along a straight line path which intersects the respective transmission shaft axis, and which, for the work pistons, coincides with the piston connecting rod centerline. Each rotary shaft then serves as a link between the hypocycloidal gearing for the respective pairs of reciprocating members.

In the preferred embodiment of the invention, however, the connecting shaft of each opposed displacer pair includes a Scotch yoke providing a slot at right angles to the connecting shaft centerline, wherein the respective hypocycloid gear crank pin is engaged; and the respective ring gear is rotationally shiftable between and anchored in selected positions at the same time certain rotational control motion is imposed on the rotary shaft, establishing distinct directions for the crank pin translation.

By this arrangement, ring gear orientation may be so selected that crank pin motion is parallel to the slot direction at each yoke and accordingly produces no displacer movement.

However, upon ring gear shift in one rotational sense or the other from the said orientation, for each displacer pair, the line of pin translation turns about the transmission shaft axis to make an angle with the connecting shaft centerline, thereby increasing the effective displacer stroke length, proportionately with the cosine of the said angle, to the extreme condition where as in my aforesaid application, the hypocycloid crank pin center translates along the displacer connecting shaft center line, which by the present invention results in a maximum displacer stroke.

By a control means or linkage connected effectively to both ring gears and the rotary shaft in the displacer transmission arrangement for simultaneously shifting the gears in the same sense equally, the displacer stroke length is effectively under adjustable control, so that as required, the stroke length may be decreased, even brought to zero with a corresponding reduction of windage energy losses at times when displacer movement is either not needed or may be reduced for the power or torque requirement of the prevailing load conditions; and simultaneously there is afforded output torque and power control of the engine.

The general object of the present invention is to provide an improved control system for hot gas engines.

Another object is to provide means for varying displacer stroke length independent of the work piston stroke length in a hot gas engine.

Another object is to provide, for an engine of the character described, control means adapted to reduce windage losses otherwise arising by displacer member motion at times of reduced torque or power demand.

A further object is to provide displacer stroke controlling mechanism of a relatively simple character.

Other objects and advantages will appear from the following description and the drawings wherein.

Figure 7:
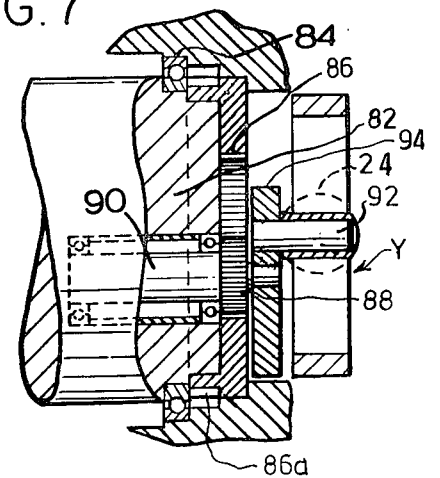
Figure 6A:
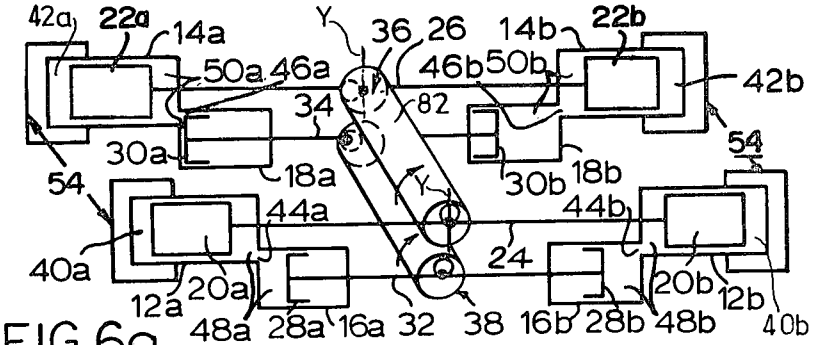
Figure 6B:
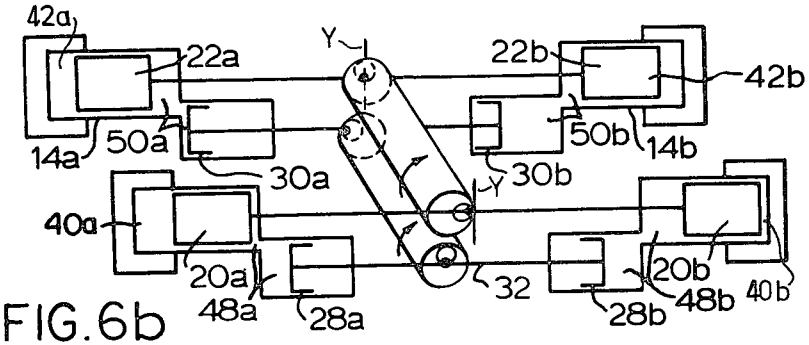
Figure 8:
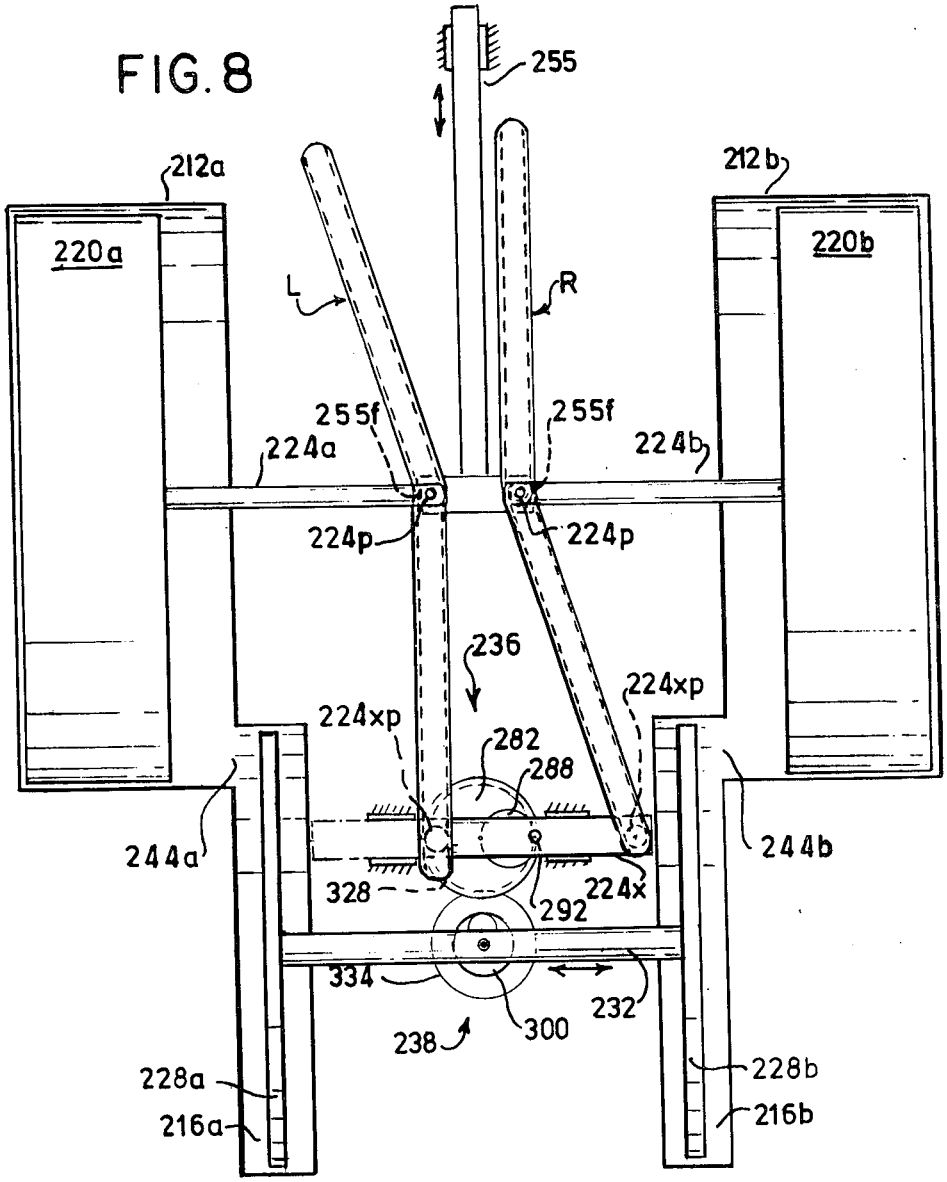

FIGS. 6*a* and 6*b* are diagrammatic representations of the basic engine elements in distinct modes;

FIG. 7 is a further detail;

FIG. 8 is a diagrammatic representation of a control modification.

GENERAL STRUCTURE: BLOCK, PISTONS, DISPLACERS AND CYLINDERS

A particular embodiment of the invention is shown in the drawings in an N-section hot gas engine, of which the general organization is best seen in FIGS, 1–2, also diagrammatic FIGS. 6*a*, 6*b*. This particular engine, with N being 4, is comprised of a generally symmetrical composite engine block *B* supporting a set of four displacer cylinders 12*a*–12*b* and 14*a*–14*b* opposed in axially aligned pairs to receive respective displacer members 20*a*–20*b*, 22*a*–22*b*, rigidly connected in aligned pairs by and supported at the block by parallel displacer connector shafts 24 and 26; first hypocycloidal transmission means, generally designated 36, for interconnecting shafts 24 and 26 and including motion converting means; in the block *B*, a set of likewise aligned paired work cylinders 16*a*–16*b*, and 18*a*–18*b* associated with and communicating with respective displacer cylinders to form a distinct working gas-filled space for each section, respective working pistons 28*a*–28*b* and 30*a*–30*b*, connected in axially aligned pairs by parallel connecting rods 32 and 34; second transmission means designated by general reference numeral 38, similarly rigidly connecting piston rods 32 and 34 and including motion converting means; a control mechanism C disposed between the two rigidly connected generally similar block halves 52—52, in each of which are formed a respective opposed work cylinder pair; heat source enclosure 54; and an output shaft 56 in a support block 58 mounted beneath one of the half-blocks.

The displacer members and cylinders are constituted of thin wall tubular stainless steel members, each closed by a thin wall at its outer end. The displacers have inner end closures threaded on the displacer connecting shaft ends. At open inner ends, the displacer cylinders are welded in eccentric apertures of respective end plate disks 60, sealed and by bolts 62 secured to opposite engine block faces to form end walls or closures for the work cylinders, which are overlapped slightly by the respective displacer cylinder open ends to provide communication passages 44*a*, 44*b*, 46*a*, 46*b*.

The respective heat source enclosures 54 surrounding the outboard ends of the displacer cylinders 12–12*b* on the left of the block, and 14*a*–14*b* on the right, are supplied with a hot heat transfer fluid, but these can be considered more broadly to be heat sources for energizing the engine.

In each of the displacer cylinders (see also FIGS. 6*a*, 6*b*) a "hot end" chamber or space 40*a*, 40*b*, 42*a*, 42*b*, respectively, is defined between the cylinder outer end and the displacer outer end when the displacer is in its innermost position; and extending within both cylinders of each associated and connected displacer and work cylinder pair 12*a*–16*a*, 12*b*–16*b*, 14*a*–18*a*, 14*b*–18*b*, a respective "cold end" chamber or space 48*a*, 48*b*, 50*a*, 50*b*, is formed between each displacer member and its associated piston.

Figure 2:
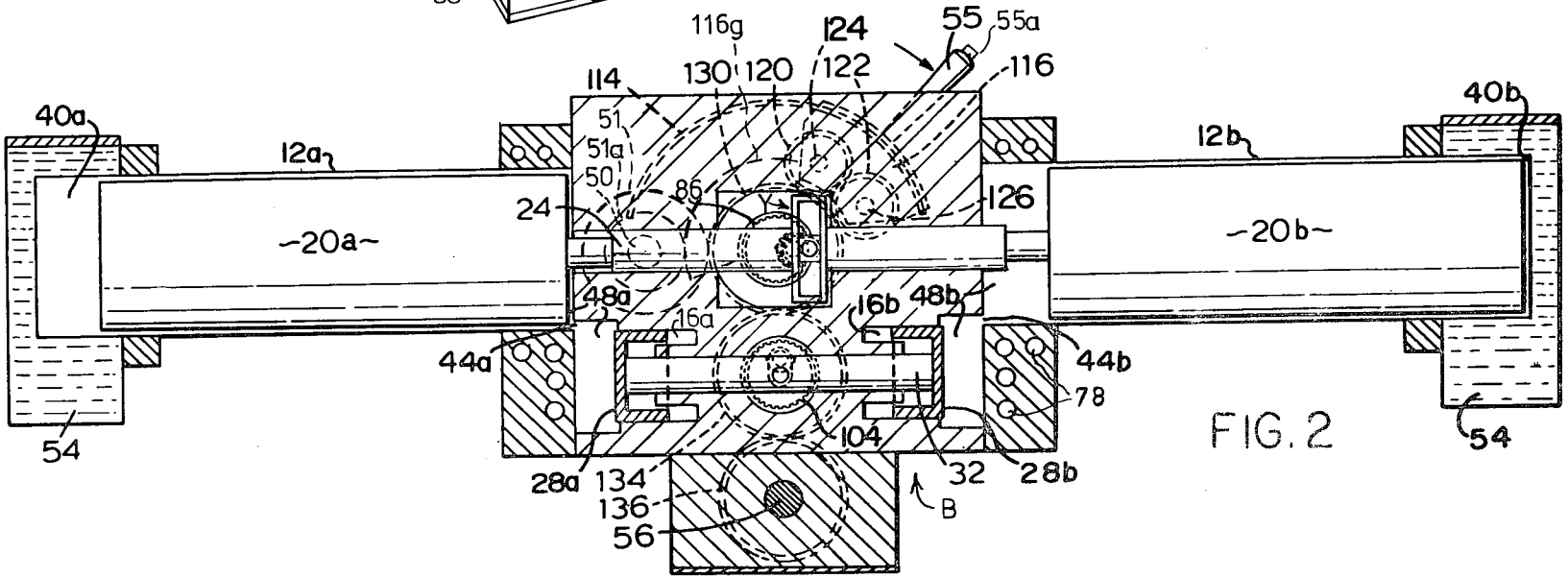
FIG. 2 is a vertical section, taken generally longitudinally through one opposed pair of displacer members and associated pistons, about as indicated by the line 2—2 in FIG. 1.

To cool the cold ends and the portion of the working gas there present, as shown in FIG. 2, for the cold ends 48*a*, 48*b*, of the displacer cylinder - work cylinder associations 12*a*–16*a*, 12*b*–16*b*, the end plates 60 are traversed by passages 78 for circulation of coolant by supply and return conduits 80.

The piston rods and displacer shafts are slidably supported in the block structure by appropriate conventional slide type ball bearings; and through conventional roll socks, i.e., rolling seals, the displacer shafts and pistons are sealed to the block.

TRANSMISSION MEANS - OUTPUT GEARING

The relation among the instantaneous positions of the pistons as a set in their reciprocation cycles in respective cylinders, and the corresponding relation among the displacers is termed an "offset" or "phase offset"; while the relation of the instantaneous positions of a working piston and its associated displacer in their cycles of reciprocation in the respective cylinder spaces is termed the "phase."

Since the reciprocating members in each pair are rigidly connected, the action in each cylinder is 180° out of phase from that in its opposite; that is, the instantaneous position and motion of a reciprocating member relative to its cylinder in its cycle is 180° out of phase with the other of the pair. Also by each transmission means, the cycles of the respective connected pairs are off-set from each other by 360°/N or 90° increments. Moreover, as later described, the two transmission means are included in interconnecting means whereby the reciprocations of each displacer and its associated piston in their connected cylinders (which may be considered an "engine section") have a definite phase relationship which is the same for all four sections of the engine.

In the first transmission means 36, a displacer transmission shaft 82 is rotatably supported at opposite ends by bearings 84 in spaced opposed recessed faces of engine block half-sections 52, with its rotational axis perpendicular to the axes of the displacer connector shafts 24, 26. Outboard of the bearings, normally stationary hypocycloid internal ring gears 86 are rotationally shiftably mounted within the block sections, just outboard of opposite ends of and coaxially of the shaft 82. Each ring gear bears an external set of teeth spanning at least 180° by which it is rotationally shifted as later described, the external teeth being conveniently provided by a complete spur gear 86*a* affixed to the inboard side of the gear 86, or intergrally formed at the same location on its periphery,. A cross-shaft 50 rotatably supported in the block has fixed thereto like end gears 51, 51, meshed with the ring gear external teeth and also intermediate its ends a further gear 51*a*.

Figure 3:
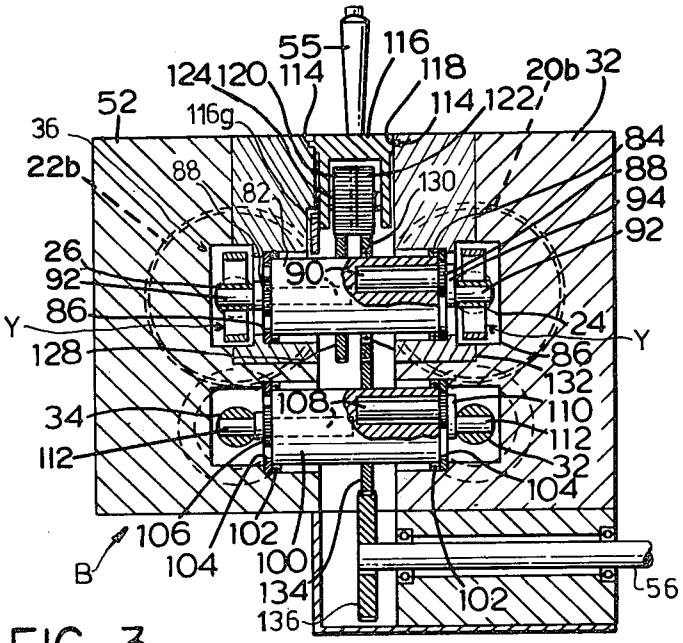
FIG. 3 is a transverse section taken generally as indicated by 3—3 in FIG. 1.

In the shaft 82, each end serves as a carrier for a hypocycloid planetary gear 88, thereon eccentrically supported rotatably by a crank shaft 90 (see right side of FIG. 3), to mesh with the respective ring gear 86; and a crank pin 92 is carried by a crank arm 94, secured non-rotationally with respect to the planetary gear 88. The axis locations of the two crank shafts are angularly spaced from one another about the axis of the shaft 82 by 360°/N, or 90°. The crank pins are engaged in respective displacer Scotch yokes Y rigidly perpendicular to and on connecting shafts 24 and 26, so that rotation of shaft 82 is converted to displacer reciprocation.

The pitch diameter of the internal ring gear is twice that of the planetary; and the spacing of each crank pin axis from its crank axis, equals the eccentricity of the crank shaft axis from the transmission shaft axis, or in effect the pin axis intersects the pitch circle of the planetary. A crank pin axis therefore, for any given ring gear setting, remains located in a plane transverse to the block, actually a diametric plane including the common axis of the ring gears 86 and shaft 82, for pin-translating movement in response to rotation of the corresponding planetary gear within the ring gear, that is, with an orbital motion of a gear 88 about the axis of shaft 82.

The Scotch yoke elements Y provide respective slots at right angles to the displacer connecting shafts 24 and 26 to receive pivotally and slidably the respective crank pins 92 fixed on the crank arms. Pins 92 of course may be pivotally engaged in conventional slide blocks which are slidably retained in the yoke slots. Hence, as long as the pin motion is not parallel to the yoke slots, by virtue of an appropriate control setting, shafts 24 and 26 are reciprocably driven in response to rotation of the transmission shaft 82, which is driven when the second transmission means rotates by gearing which also forms part of the control adjustment mechanism to be described. However, the ring gears 86, though angularly, i.e., rotationally, shiftable in the block, have a fixed orientation relative to each other, through gears 51 and shaft 50, and the planetaries are meshed in the ring gears with relative crank arm orientations such that in the set successive 90° differences or offsets in phase are present.

The second transmission means 38, basically similar to the first, includes a piston transmission shaft 100 mounted in bearings 102, fixed ring gears 104 meshed with planetary gears 106, planetary gear supporting crank shafts 108 here again with 90° angular spacing, and crank arms 110 bearing respective crank pins 112. But here the crank pins are engaged in diametric bores of the piston connecting rods 32 and 34, and the gears 104 are not operatively shiftable for any purpose.

The second or piston transmission shaft 100 rigidly mounts a gear member 134 meshed with an output transmission gear 136 fixed on the output shaft 56, so that rotation of shaft 100 by reciprocation of piston shafts 32–34 drives the output shaft; and conversely, rotation of the output shaft 56 reciprocates the pistons. Also with an appropriate control setting, rotation of the gear 134, either by piston action when the engine is developing power or by load motion coupled through shaft 56, causes displacer reciprocation by further gearing which also forms part of the control adjustment mechanism.

DISPLACER STROKE LENGTH AND OUTPUT CONTROL

As the control input point, a slide member 116, with handle 55 for manual control, is supported in opposite recessed faces of the half-blocks 52, by slidable engagement of its arcuate side ribs or rails 118 in arcuate slots 114 coaxial of shaft 82. There is available a slide movement of at least a 45° arc in opposite directions from the central or neutral position.

The slide member 116 is desirably retained or secured at selected position by conventional means 55*a*, such as a detent latch or preferably a releasable friction device or the like enabling stepless change, unless with spring bias return of 116 to neutral, an accelerator pedal linkage or the like is used.

In a U-shaped recess of the slide, shafts 124, 126, rotatably carry the meshed gears 120 and 122 further respectively meshed with gears 128 and 130 supported by the first or displacer transmission shaft 82. The gear 128 is fixed on shaft 82, but gear 130 is rotatably carried by a bearing 132, and in turn meshed with the piston transmission shaft gear 134; the various gear ratios being chosen to give at 1 to 1 rotation of shafts 82 and 100 in the same sense; e.g., with 128, 130, 134 of equal size and also 120 equal to 122.

Thus shaft 82, shaft 100, and the output shaft 56 rotate in fixed relation to each other, and thus to the reciprocation of the pistons. Further, the rotation of shaft 82 imparts reciprocation to the displacers, as long as the crank pins 92 are moving in paths which are not parallel to the slots of yokes Y.

Figure 5:
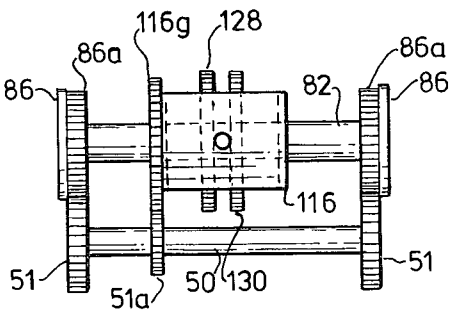
FIGS. 4 and 5 represent certain elements in outline form and separately from surrounding structure to show more clearly their structural relation and mode of operation.
Figure 4:
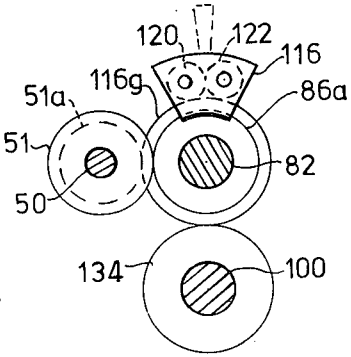

A spur gear or gear segment 116*g*, with pitch circle coaxial with the ribs 114 and grooves 118 and hence with transmission shaft 82 (see FIGS. 3, 4, 5), is affixed to one side of slide 116 and meshes with the gear 51*a* fixed intermediate the ends of a shaft 50. With the end gears 51, 51 on shaft 50 having a 1 to 1 ratio with the ring gear external teeth at 86*a*, and the gear or gear segment 116*g* having a multiplying 2 to 1 drive ratio with the middle gear 51*a*, an angular shift of handle 55, therefore at slide 116, results in an angular shift of double that amount and in the same sense at the ring gears 86. Since the ratio of the internal ring gears 86 to the planet or crank gears 88 is 2 to 1, the planets would rotate (assuming axes stationary) by four times the amount of a control slide angular shift "*a*" and in the same sense, i.e., a rotation of 4*a*.

Again considering the engine stationary for simplicity, therefore gear 134 and hence gear 130 stationary, a given angular shift "*a*" of control slide 116 causes rotation of gear 120 and its shaft 82, hence an "orbiting" shift of the axes of planets 88 in the same sense but in twice the angular amount, or 2*a*, which itself would cause a crank orientation change of 2*a*. But since the ring gears are considered now stationary, the orbiting planets also would rotate about their axis in opposite sense by an amount 4*a*, giving a net crank and pin orientation change just equal to the angle of orbit motion, i.e., twice the amount of but opposite in sense to the angle of control slide motion, i.e., of $-2a$.

Of course, actually the ring gear shift and rotation of shaft 82, hence orbital motion imposed on the planetaries occur simultaneously with the control slide shift, with the net change for a planetary and its associated crank pin being the shift in planet axis position due to the imposed orbiting, that is, twice the control shift in some sense; and a change in pin angular orientation in space due to the algebraic summing of gear rotation due to ring gear shift and to orbiting motion, which is a net of twice the control shift in the same sense, or $+2a$.

Also it should be noted that with the ring gear held stationary, and considered apart from connections to piston rods and displacer shafts, from any orbit position at which a planetary is assembled, with its crank pin at a point or the pitch circle of the ring gear, then during an ensuing complete orbit the pin moves along the pitch circle diameter from that starting point to the opposite side and then returns, oscillating thus in all following orbits, i.e., in each successive rotation of the transmission shaft which serves as its carriers. With uniform rotation, this rectilinear oscillation is simple harmonic motion.

In the case of the planetaries for the second, or piston transmission means, they are so meshed with their ring gears upon assembly that the diametric pin path of each is parallel to the piston rods, which is the condition shown in the drawings.

When a 90° piston-displacer phase difference is to prevail for the engine operation at maximum torque, with the setting of slide 116 for the zero torque condition, hence handle 55 at vertical, i.e., central or neutral position, the first or displacer transmission means is assembled with the orientations of the transmission shaft and of the planetaries with crank arms, and pins relative to each other and to the piston transmission means as shown in FIG. 6*a*, when the latter has the orientation or disposition there depicted. In the diagrammatic FIGS. 6*a* and 6*b*, at the ends of the cylinders representing transmission shafts 82 and 100, heavy dots and small circles indicate pin and planetary positions; and the vertical lines the centerlines of the yokes.

It is seen in FIG. 6*a* that the displacers 20*a*–20*b*, 22*a*–22*b* are at mid-length position in their cylinders; hence that the yokes Y are at central positions, i.e., at the axis of shaft 82, with the planet for connecting shaft 24 at 12 o'clock position, and its pin uppermost, i.e., at the pitch circle, while at the opposite end for shaft 26 the planet is at 9 o'clock, but with its pin at 3 o'clock, hence at the axis of shaft 82. Hence with rotation of shaft 82 these pins move on the vertical diameter of the ring gear, therefore parallel to the yoke slots; and accordingly no motion is imparted to the displacers.

Therefore in a vehicle propulsion application, even though there be a positive direct connection or transmission from engine output shaft to the wheels and the vehicle be moving with consequent piston reciprocation, the displacers are not reciprocated, thereby to reduce windage energy losses which would occur were the displacers moving.

Even though the engine system be up to operative conditions, that is, with heat sources 54 and the cold end cooling system at their respective "hot" and "cold" temperatures, with no displacer movement, there is no net torque developed, whether the pistons be stationary or reciprocating. Therefore the control setting at midpoint or vertical, which results in the relations of FIG. 2, is indeed a neutral or a zero power or zero torque setting.

From the aforegoing description, it is apparent that the line or plane of pin oscillation is thus shifted by an angle twice the controller slide shift, and therefore that the length of the displacer stroke is proportional to sin(2*a*) where "*a*" is the control slide angular setting away from zero position; or is proportional to the cosine of the angle between the pin path and displacer shaft plane.

CONTROL OPERATIONS FOR TORQUE

Figure 1:
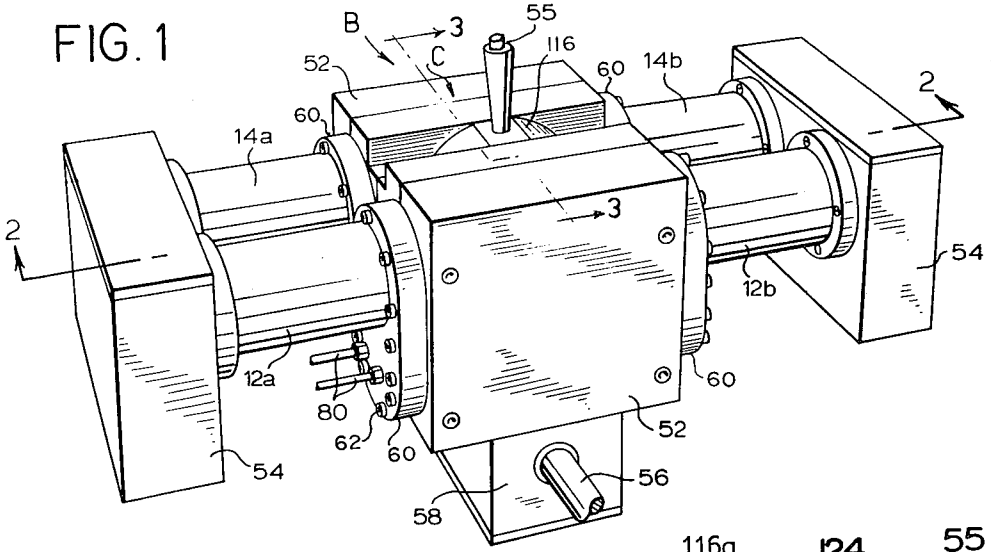
FIG. 1 is a perspective view of one form of hot gas engine wherein a preferred form of the present invention is incorporated.

To bring the displacers into cooperative movement with respect to their associated pistons, the slide 116 is moved by handle or lever 55, to one side or the other of the neutral position with corresponding direction selection; a movement to the right, from the neutral position shown in FIGS. 1 and 2, resulting in clockwise movement of shaft 100 (see FIG. 3) and a corresponding counter clockwise movement of the output shaft 56, considered "forward."

For simplicity of discussion, the engine is considered stationary and in the condition of FIG. 6*a*. Assuming a full forward 45° angular movement of the slide to the right, and gear 130 held against shift by its ultimate geared connection to the load, there immediately results a 90° displacement or shift of the displacers 20*a*–20*b* to the right with respect to the pistons 28–28*b* with not only a 90° orbital shift of the planetary adjacent displacer shaft 24 to 3 o'clock, but also rotation of its pin to 3 o'clock relative to its axis, to a point also at 3 o'clock on the pitch circle. The path for pin travel then has also shifted 90° to be perpendicular to the yoke. On the other hand, for the planetary adjacent the displacer shaft 26 the orbiting movement from 9 o'clock with pin at 3 o'clock by 90° to 12 o'clock is also accompanied by a 90° net pin rotation to 6 o'clock relative to the crank axis, so that the pin remains centered, and the displacers 22*a*–22*b* are not shifted; but in effect the path of pin movement has been rotated 90°, i.e., to a disposition parallel to 26, perpendicular to its yoke Y. Therefore upon rotation of shaft 82, the displacer stroke length will be the maximum available; and the crank shafts in the displacer transmission are ahead of those in the piston transmission means by 90° in clockwise sense. (see FIG. 6*b*)

Though for any intermediate slide setting less than 45°, the stroke length accordingly is shorter, the 90° phase relation of each displacer to its piston is maintained. However, due to the decrease in the volume of gas displaced per cycle between the hot and cold ends at each engine section, the torque developed is decreased. Thus torque and power control, consequently also load speed control, are afforded.

When the controller is set to neutral position, and the engine stops say with vehicle brought to a halt, the actual positions of the piston may be somewhat indeterminate and, due to inertial or friction loadings, may remain at other than an equilibrum position or condition that would otherwise be assumed. Hence as a starting point even the condition of FIG. 6*a* may be taken as presenting a stationary engine condition with controller at neutral, though cold and hot region temperatures are at operating ranges.

An immediate self-starting of the engine is effected by moving the handle 55 from the vertical (or "neutral") position of FIG. 1 or 2 to the 45° extreme right position. This action, resulting in the changes above described to the condition of FIG. 6*b*, by movement of the displacer member 20*a* away from its position shown in FIG. 6*a* to its position shown in FIG. 6*b* displaces a substantial volume of gaseous medium from the cold end 48*a* to the hot end 40*a*. This gaseous working medium will be immediately placed in an intimate heat transfer relationship with the heating fluid of the heat source 54 which encloses the hot end.

This results in the rapid heating of a substantial volume of the gas to cause an increase in pressure in the hot end 40*a* which will be translated to an increase in pressure in the cold end 48*a*. Simultaneously the hot gas, which was previously located in the hot end 40*b* of the opposite displacer cylinder 12*b*, is transferred to the cold end 48*b* to be rapidly cooled. This action establishes a pressure differential to cause the piston 28*a* to move to the right. The consequent motion of piston rod 28, transmitted through the first and second transmission means and associated gearing to displacers 22*a*–22*b* and pistons 30*a*–30*b*, then initiates also the hot gas cycles in the other two engine sections for forward torque development. A 45° leftward setting of the control slide simply moves the crank pins to positions 180° away from those in FIG. 6*b*, thus to locations 90° counter clockwise ahead of the crank shafts in the piston transmission means, the displacers 20*a*–20*b* being shifted to the left, so that reverse torque is developed.

The lever arm 55 may be moved to any position to adjust the displacer stroke length as required both when the output shaft is stationary and also when rotating in either direction. The force required to move the displacers is quite low, for it is necessary only to overcome gas friction plus the inertia and friction of the translating and rotating members.

By reason of the fact that the apparatus is a multi-cylinder apparatus with a set of four working pistons 90° out of phase with respect to one another, that is, having within the set like phase offsets or differences of 90° when the instantaneous piston positions are considered successively in the order at which each say starts its power stroke during a complete engine cycle, therefore the torque applied at any point during the operating cycle is substantially uniform.

Since this control system enables adjustment of the displacer stroke length down to zero where there is no gas movement by displacer action, and thus no torque development or exchange of energy, the engine can be coupled directly to the power output shaft of a vehicle without the use of a clutch mechanism.

Since a 45° lever movement from neutral toward the left, opposite to that above described, will result in a reversal of output shaft torque, the control system also may be used to advantage for braking the power output shaft with a regenerative effect. For when the engine is driving the load with the phase required to provide a driving torque, thermal energy from sources 54 is converted to mechanical energy; and when the phase is reversed for braking of the engine, mechanical energy is converted to heat energy. Therefore regeneratively heat is returned to the heat storage or sources 54.

Where in each engine section it is required to have other than a 90° phase relation between piston and displacer, the meshing of the gears intervening between the piston transmission shaft and the displacer transmission shaft may be selected to vary this relation by the small angular increments represented by the pitch, or spacing between successive teeth. It should be noted that the dynamic balancing of the moving parts as described in my aforesaid patent may be also here used.

From the aforegoing it will be apparent that the present invention provides a self-starting hot gas engine which is of simple construction, which is capable of self-starting in either direction and providing up to and including full torque at any position of the output shaft under all load conditions; and further may afford regenerative braking for conservation of energy.

The displacer stroke adjustment is also operable to adjust the speed of operation of the engine, and provides an instantaneous continuously controllable accelerating or decelerating torque, including zero torque for any shaft position, any shaft speed and direction including a stationary condition. It will be apparent that the displacer stroke adjustment principle of the present invention may be used in a hot gas engine of a type which does not employ the horizontally opposed relationship of pistons and displacers.

FIG. 8 MODIFICATION

Another mechanism for displacer stroke control is shown in FIG. 8 which diagrammatically presents two opposed engine sections, for example, one half of a four-section hot gas engine, and having essential components and relations as disclosed for FIGS. 1–2, though with different piston and displacer proportioning. Accordingly parts similar or analogous to those of FIG. 1 are designated generally with reference numerals higher by two hundred.

The work cylinder spaces 216*a*–216*b* and the displacer cylinder spaces 220*a*–220*b*, as for the FIG. 1 engine form, are aligned in opposed pairs, with work cylinders communicating with the respective displacer cylinders to receive a respective mass of the gaseous working medium. The aligned opposed pistons 228*a*–228*b* here also are rigidly connected by a common piston connecting rod 232; and, in the hypocycloidal gearing type motion converting mechanism 238, similar to that previously described for the second transmission means of FIG. 1, a transmission shaft 300 here also may have each end serving as a carrier for the planet gear of respective hypocycloidal gearing assemblies, for two pairs of opposed pistons again as a set with phase offset of 360°/N, i.e., 360°/4. Similarly also, shaft 300 is geared to an output shaft (not shown), and further as in FIG. 1 has 1 to 1 gearing 328, 334, to a shaft 282 of a motion converting mechanism 236 associated with the displacers. The gearing meshing between shafts 282 and 300 establishes the phase relation between displacer and piston in each engine section.

The displacer connector shafts and piston rods are of course appropriately slidably supported in the engine block or housing. Here as permitted by the size and proportioning of the pistons and displacers the motion converting mechanism 236 is notably larger than mechanism 238; and a slide shaft or bar 224*x* slidably supported on the housing is reciprocatingly driven again by crank pin 292 on a hypocycloidal planet gear 288 carried by member 282 precisely in the fashion of the displacer connector shaft drive in FIG. 1; and shaft 282 again may have each end thus serving as a planet carrier for a four-section engine, again for displacer motion phase offsets of 360°/4 in the displacer set.

Slide bar 224*x*, however, is connected to the respective displacers by a pivotal linkage arrangement which affords displacer stroke length adjustment for power, torque and speed control; and therefore the ring gears of the hypocycloidal gearing are fixed.

The control linkage includes a preferably spring-biased control bar 255 providing shiftable fulcrums for two rigid elongated oblique channel section members L, R, which are pivotally connected at respective apical centers to the aligned displacer connector shafts by pivots 224*p*, 224*p*, and at bottom ends to opposite ends of rod 224*x* by sliding or roller pivots 224*xp*, 224*xp*, shiftably engaged in the channels.

The control bar 255, vertically slidably guided and firmly supported by appropriate structure, at its inverted T-shaped bottom end carries a spaced pair of rolling or sliding pivots 255*f* and 255*f* engaged and translatable in the channel faces of the link members thus to afford shiftable fulcrums. A similar control linkage arrangement is provided from the other end at shaft 282 for the second pair of engine sections, with fulcrums carried by the same control bar. The control bar may itself be manually directly moved to desired engine performance setting, or may be operated by other convenient means.

Thus with the fulcrum pivots in the neutral position shown, coinciding axially with the displacer shaft pivots, no motion is imparted by link oscillation consequent upon rotation of shaft 282, and the displacers remain stationary at the extreme hot end positions in their cylinders. On the other hand, when by control bar shift the fulcrum pivots are moved above or below the neutral position, an effective lever arm is developed between the fulcrum and displacer pivots, and the displacers will be driven from shaft 282. The control bar with fulcrums may be spring-biased to return to this neutral position.

An increasing stroke length results with increasing spacing of the fulcrums from the displacer pivots, i.e., longitudinally along the straight arms of the levers from neutral position; but the phase relation prevailing in each engine section is reversed. The arms of each lever or link member are oblique to each other to provide operating clearance since they swing in a common plane.

The effect and advantages of displacer stroke length control in operation, of reversibility in piston displacer phase relation and, for self-starting, say a four section engine, of the initial shift of the displacers upon change of the controller out of neutral setting, are as described relative to FIGS. 1–6*b*.

What is claimed is:

1. A hot gas engine comprising:

a housing supporting a rotary output element;

a displacer cylinder space associated with the housing and having one end serving as a hot chamber end;

a work cylinder space associated with said housing and communicating with the other end of, and with the displacer cylinder space defining a space receiving a gas as the engine fluid working medium;

a displacer mounted to reciprocate in the displacer cylinder space and having a displacer connector shaft projecting from the displacer cylinder space and slidably mounted relative to said housing;

a piston slidably mounted in the work cylinder space and having a piston connecting rod projecting from the work cylinder space and slidably mounted relative to said housing;

motion converting means connecting the piston rod and the output element for motion conversion between reciprocation of the piston and rotation of the output element;

interconnecting means interconnecting the piston with the displacer for reciprocating the displacer at the same rate as and with a predetermined phase relation to the piston reciprocation; the last said means including control means for varying the displacer stroke length for a maximum stroke length to a zero stroke length thereby varying the gas volume moved by the displacer in each engine cycle for control of developed torque, and for zero torque development with output element rotation by continued load motion to avoid windage energy losses due to displacer motion by providing a stationary condition of the displacer.

2. A hot gas engine as described in claim 1, wherein the control means enables a selective reversal of the said phase relation thereby to select direction of output shaft rotation with torque control by displacer stroke adjustment for both directions of output rotation.

3. A hot gas engine as described in claim 1, comprising a plurality of N engine sections, with N being at least 3, and with each section including a said displacer cylinder space and a said work cylinder space having therein respectively a said displacer and a said piston, and also including a said interconnecting means;

said motion converting means connecting the rods of the pistons to the output element with successive phase offsets of 360° /N; said interconnecting means including a common element whereby the displacers are constrained to move with phase offset of 360° /N;

said control means being effective simultaneously to vary the stroke lengths of the several displacers.

4. A hot gas engine as described in claim 1, wherein said interconnecting means comprises a Scotch yoke carried rigid on the displacer connector shaft; and a member rotationally driven by said piston through the motion converting means and carrying a crank pin engaged in and reciprocating said yoke; and said control means comprises means for changing the pin motion component perpendicular to said yoke.

5. A hot gas engine as described in claim 1, wherein said interconnecting means comprises a Scotch yoke rigid on the displacer connecting shaft;

a shaft member rotationally driven by said piston through the motion converting means, and having axis perpendicular to the displacer connecting shaft;

a rotatably shiftable ring gear concentric with the shaft member;

a hypocycloidal gear rotatably eccentrically carried by the shaft member and meshed within the ring gear;

said hypocycloidal gear having a pitch diameter half that of the ring gear and bearing a crank pin at its pitch circle and engaged in said yoke;

a control gear coaxial with the shaft member and coupled by first gearing to shift said ring gear;

second gearing means moved with said control gear for imparting rotation to the shaft member simultaneously with and in the same sense as shift of the ring gear;

whereby upon drive of the shaft member from the piston said crank pin is driven to oscillate in a plane including the axis of said shaft member, and whereby through angular setting of said control gear the pin oscillation plane may be set at a position parallel to said yoke for a zero displacer stroke length, that is, for stationary condition of displacer with no torque developed or absorbed by the engine with a neutral setting of the control gear, and by control gear settings progressively to either side of neutral, the plane may be rotated into positions progressing to perpendicularity to the yoke and thereby selectively affording increased displacer stroke lengths, and also change of engine operation directions by the control gear setting from one side to the other of the neutral setting.

6. A hot gas engine as described in claim 1, comprising four engine sections, with each section including a said displacer cylinder space and a said work cylinder space having therein respectively a said displacer and a said piston, and also including a said interconnecting means;

said displacer cylinder spaces being arranged in pairs of aligned opposed spaces with the displacers in each pair having a common displacer connector shaft;

said work cylinder spaces being arranged in pairs of aligned opposed spaces with the pistons in each pair having a common piston connecting rod;

said motion converting means connecting the rods of the pistons to the output element with successive phase offsets of 90°; said interconnecting means constraining movement of the displacers to simultaneous movement with phase offset of 90° and comprising a respective Scotch yoke rigid on each common displacer connector shaft, respective hypocycloidal gearing associated with each common displacer connector shaft including a rotationally shiftable ring gear, a hypocycloidal planet gear rotationally eccentrically supported on a rotationally driven carrier to orbit meshed within said ring gear, and means commonly driving the carriers and geared to the motion converting means; said planet gear having a pitch diameter one half that of the ring gear and bearing a crank pin engaged in the respective yoke and located at the planet pitch circle whereby the pin oscillates in a plane diametric to the ring gear;

said control means being effective simultaneously to vary the stroke lengths of the several displacers and including a control gear coaxial with the ring gear and coupled by first gearing to shift both said ring gears simultaneously and in the same sense, and second gearing means moved with said control gear for imparting rotation to the carriers simultaneously with and in the same sense as the shift of the ring gears;

whereby upon drive of the carriers from the piston said crank pins are driven to oscillate in a plane including the rotation axis of said shaft carriers, and whereby through angular setting of said control gear the pin oscillation plane may be set at a position parallel to said yokes for a zero displacer stroke length, that is, for stationary condition of the displacers with no torque developed or absorbed by the engine with a neutral setting of the control gear, and by control gear settings progressively to either side of neutral, the plane may be rotated into positions progressing to perpendicularity to the yokes and thereby selectively affording increased displacer stroke lengths, and also change of engine operation directions by the control gear setting from one side to the other of the neutral setting.

7. A hot gas engine as described in claim 6, wherein said carriers are provided by a common shaft member disposed coaxially with said ring gears with the planet gears eccentrically supported in opposite ends of the common shaft member.

8. A hot gas engine as described in claim 7, wherein said control gear is provided with and shiftable by a control lever;

said first gearing provides a 2 to 1 rotational shift multiplication from said control gear to the ring gears; said second gearing provides 2 to 1 rotational shift multiplication from said control gear to orbiting shift of the planet gears.

9. A hot gas engine as described in claim 1, comprising two engine sections, with each section including a said displacer cylinder space and a said work cylinder space having therein respectively a said displacer and a said piston, and also including a said interconnecting means;

said displacer cylinder spaces being arranged in an aligned opposed pair with the displacers in each having a aligned displacer connector shafts;

said work cylinder spaces being arranged in an aligned opposed pair with the pistons in the pair having a common piston connecting rod;

said motion converting means connecting the rods of the pistons to the output element with successive phase offsets of 180°; said interconnecting means constraining movement of the displacers to simultaneous movement with phase offset of 180° and comprising a slide shaft supported for axial reciprocation in spaced parallel relation to the displacer connector shafts, hypocycloidal gearing associated with each common displacer connector shaft including a fixed ring gear, a hypocycloidal planet gear rotationally eccentrically supported on a rotationally driven carrier to orbit meshed within said ring gear, means driving the carrier geared to the motion converting means, said planet gear having a pitch diameter one half that of the ring gear and bearing a crank pin engaged in the slide bar and located at the planet pitch circle, with the pin linearly oscillatable in the axial direction of the slide bar, a pair of like link bars each having a fulcrum support relative to the housing and each pivotally connected intermediate its ends to a respective displacer connector shaft and at respective corresponding ends slidably pivotally connected to opposite ends of the slide bar, the axes of the pivotal connections being parallel;

said control means being effective simultaneously to vary the stroke lengths of the displacers and including a control bar slidable in a direction perpendicular to the slide bar and fulcrum pivots carried by the control bar and longitudinally slidably engaged with and providing the fulcrum support for the respective link bars, the fulcrum pivot axes being parallel to the axes of the slide bar pivotal connections;

whereby upon drive of the carrier from the pistons said crank pin is driven to oscillate in a plane including the axis of said slide bar; and whereby through linear setting of said control bar the fulcrum locations may be set at a position coincident with the common axis of the aligned displacer connector shafts for a zero displacer stroke length, that is, for stationary condition of the displacers with no torque developed or absorbed by the engine with a neutral setting of the control bar, and by control bar settings progressively to either side of neutral, the fulcrums may be set into positions progressively remote from said common axes of the displacer shafts to provide effective lever arms between fulcrums and displacer pivots and thereby selectively affording increased displacer stroke lengths, and also change of engine operation directions by the control bar setting from one side to the other of the neutral setting.

10. A hot gas engine as described in claim 9, including two further engine sections with components as there described wherein all four pistons are connected to a common output rotary element with a 90° phase offset, the two carriers are driven from a common rotary element, and the planets are meshed to the respective ring gears with relative orientation providing 90° phase offset in motions of the displacers, and a single control bar carries the fulcrum pivots in the control means for both pairs of engine sections, thereby to form a four-section engine capable of self-starting.

* * * * *